US006000563A

United States Patent [19]

Greenberg

[11] Patent Number: 6,000,563

[45] Date of Patent: Dec. 14, 1999

[54] SIDEBOOM ASSEMBLY

[76] Inventor: Alan Greenberg, 2811A Ferndale, Houston, Tex. 77098

[21] Appl. No.: 09/088,787

[22] Filed: Jun. 1, 1998

Related U.S. Application Data

[63] Continuation-in-part of application No. 08/925,501, Sep. 8, 1997.

[51] Int. Cl.[6] ..... B66C 23/46

[52] U.S. Cl. ..... 212/289; 212/258

[58] Field of Search ..... 212/289, 258, 212/196; 414/745.6

[56] References Cited

U.S. PATENT DOCUMENTS

| | | | |
|---|---|---|---|
| 3,523,614 | 8/1970 | Walker | 212/289 |
| 5,107,997 | 4/1992 | Worsley | 212/289 |
| 5,805,137 | 9/1998 | Yasutake | 345/156 |

FOREIGN PATENT DOCUMENTS

| | | | |
|---|---|---|---|
| 1202528 | 8/1970 | United Kingdom | 212/289 |
| 1202530 | 8/1970 | United Kingdom | 212/289 |

*Primary Examiner*—Thomas J. Brahan
*Attorney, Agent, or Firm*—Harrison & Egbert

[57] ABSTRACT

An assembly is provided that enables the operation of all hydraulic sidebooms to be achieved while simultaneously inherently avoiding commonly recurring problems attributable to inadvertent contact between the hook block and the upper block or to an impending tipping condition. Application of joystick technology is provided to enable simultaneous manipulation of the boom and load, wherein a long-established, routinely-accepted combinatin of two to three controls is replaced by a single joystick control. A fail-safe thumb actuator is also provided for a single joystick control. An anti-contacting feature is provided that stops the upward travel of the hook block if it is about to come in contact with the sideboom's stationary upper block, and thus preventing consequent damage that wound result if contact took place. All hydraulically-operated sidebooms are inherently insulated from the occurrence of unsafe conditions attributable to exceeding machine capacities by an anti-tipping feature that monitors a combination of boom angle and weight of the line load.

12 Claims, 12 Drawing Sheets

SIDEBOOM ASSEMBLY

RELATED APPLICATIONS

This application is a continuation-in-part of pending U.S. application Ser. No. 08/925,501 filed Sep. 8, 1997.

BACKGROUND OF THE INVENTION

The present invention relates to sidebooms used for pipelaying, and more particularly pertains to methods and apparatus providing a simplified control system for improving the handling of the plurality of controls for operating the boom and load of hydraulically-operated sidebooms, and for providing a plurality of apparatus for fail-safe operation of these sidebooms during pipelaying.

It is well known in the art that tractor-type vehicles having an integrated adjustable boom disposed on a side thereof are commonly used for pipelaying. Referred to as "sidebooms," such vehicles were mechanically-operated in their first incarnation and are now readily available from original equipment manufacturers in hydraulically-operated models. The use of hydraulically actuated booms and hoist assemblies is described by Stefanutti in U.S. Pat. No. 3,265,218, wherein hydraulic cylinders are used either inside or astride the boom to raise and lower the boom. The apparatus taught by Stefanutti has not been widely accepted in the art.

As taught by Vinton in U.S. Pat. No. 3,938,669, however, while the introduction of such hydraulically-operated sidebooms were anticipated to provide improvements associated with effectively and safely manipulating winches and cables through an operator's interfacing with clutches, brakes, and levers for controlling the position of the boom and for hoisting and lowering a load, such sidebooms failed to provide the prerequisite control and versatility. To attempt to remedy this deficiency in the art, Vinton discloses a hydraulic circuit that includes two separate sources of hydraulic fluid for controlling sideboom movement-related functions. One fluid source provides low volume hydraulic fluid for accomplishing not only precise, low-speed manipulation and control, but also for preventing anti-drift of both boom and hoist. The other fluid source provides high volume hydraulic fluid for providing high-speed operation of these movement and control functions. The plurality of control valves inherent in the Vinton circuit for controlling the hoist and the boom motors are operated via two levers. This apparatus also incorporates a hydraulic cylinder, instead of a drum/cable arrangement for controlling the boom; no drums or cables are involved in raising or lowering either the boom or the hook, except a short cable connected to the hook at the end of a hydraulic cylinder. As is known by those skilled in the sideboom art, this methodology was a commercial failure.

As a further development in the sideboom art, Forsyth teaches in U.S. Pat. No. 5,332,110 a hydraulically-operated sideboom intended to prevent boom over-rotation, to impart positive drive to the boom and load winches, and to provide improved control over free fall and vertical kick-out. These safe operating features are particularly intended for pipelaying applications involving lifting and lowering of large pipes.

As will be understood by practitioners in the art, the drawworks systems known in the art are operated by a sophisticated combination of clutches and brakes in order to control the cooperative movement of the boom and the load. Moreover, a drawworks system built upon a discontinued mechanically-operated, low-drive sideboom—having significantly more controls than a conventional discontinued tractor—inherently suffers from a panoply of problems associated with the simultaneous use of a daunting ensemble of gear-shifting mechanisms, clutches, and brakes, all operated by 6 different hand controls to properly lift and manipulate heavy pipes under conditions generally characterized by unpredictable and adverse terrain. Pipeline construction companies constitute approximately 95% of the users of this type of machinery. As will be appreciated by those conversant with the art, historically, such pipeline construction companies have had to choose either one of the newer high-drive sidebooms with herein before mentioned faults and high price or one of the discontinued low-drive sidebooms that are more economical but are more dangerous and are very difficult to operate. Manufacturers such as Komatsu, Fiat-Allis, Mid Western, and Caterpillar now build pipelayers with a hydraulic system that includes two to three hand controls for operating sideboom winches for handling pipes during pipelaying operations. It should also be noted that, as the pipelaying industry continues to mature, the number of skilled sideboom operators has gradually diminished.

As should be evident to those skilled in the art, it would be advantageous for construction companies who engage in pipelaying operations to have the benefit of improved handling, safety, and efficiency. It would be also advantageous for pipeline contractors to have the ability to utilize sidebooms that achieve a level of safety heretofore unmatched by any other sideboom system known in the art, regardless of design. Of course, it would be advantageous for pipelaying contractors to have the benefit of a hydraulic sideboom that inherently simplifies or mitigates the two to three controls associated with controlling the lifting and lowering of a pipe load. Accordingly, these limitations and disadvantages of the prior art are overcome with the present invention, and improved means and techniques are provided which are useful for controlling boom and load maneuvering with a single lever, for providing a fail-safe anti-tipping feature, and for providing a fail-safe anti-two-blocking feature—all of which enable efficient and safe pipelaying operations heretofore unknown in the sideboom art.

SUMMARY OF THE INVENTION

In accordance with one aspect of the present invention, an assembly is provided that enables the operation of all hydraulic sidebooms to be achieved while simultaneously inherently avoiding commonly recurring problems attributable to inadvertent contact between the hook block and the upper block or to an impending tipping condition. The present invention also provides a novel application of joystick technology to facilitate simultaneous manipulation of the boom and load, wherein a long-established, routinely-accepted combination of two to three controls is replaced by a single joystick control. Another aspect of the present invention affords a fail-safe thumb actuator means for a single joystick control. Thus, the present invention provides an expeditious manner and means for superseding the two to three hand controls typically manufactured on current sideboom models by Mid-Western, Fiat-Allis, Caterpillar, Komatsu, etc., with a single joystick control and concomitant actuator.

As will be appreciated by those skilled in the art, it is an advantage of the present invention that an anti-contacting feature is provided that stops the upward travel of the hook block if it is about to come in contact with the sideboom's stationary upper block, and thus preventing consequent damage that would result if contact took place. Such damage could include breaking the load line, resulting in the hook block and its load coming free of the load line. Hence, under such impending contacting conditions, under the teachings of the present invention, the load would instantly fall to the ground.

As will also be appreciated by those skilled in the art, the present invention enables all hydraulically-operated sidebooms to be inherently insulated from the occurrence of unsafe conditions attributable to exceeding machine capacities by monitoring a combination of boom angle and weight of the line load. Thus, the anti-tipping feature taught by the present invention assures safe operation and tends to maximize the longevity of sidebooms by meeting and even exceeding modern safety standards for lifting devices.

It is an advantage and feature of the present invention that single joystick control is provided that can actuate either winch separately or both winches simultaneously. That is, the joystick means taught by the present invention simultaneously actuates the load line and the boom line. Depending upon the positioning of this joystick control, one such line may be caused to operate at a faster speed than the other line. This behavior, of course, affords the operator complete variable speed control over both winches.

It will also be appreciated that the actuator of the present invention prevents the sideboom operator from inadvertently actuating the single joystick control while moving about in the operator compartment as the thumb actuator must be depressed in order for the joystick control to be active.

It is an object of the present invention to provide an assembly for providing an anti-contacting or anti-two-blocking feature on hydraulically-operated sidebooms.

It is another object of the present invention to provide an assembly for providing an electronic computerized anti-tipping feature on hydraulically-operated sidebooms.

It is yet another object of the present invention to provide a hydraulically-operated assembly for sidebooms, wherein all boom and load movements are controlled by a single joystick control means.

It is still another object of the present invention to provide a hydraulically-operated sideboom assembly that has a single joystick control means which can cause both the boom and the load winches to be actuated under power in both directions simultaneously.

It is another object of the present invention to provide a hydraulically-operated assembly for sidebooms, wherein all boom and load movements are controlled by a single joystick control means which, for safety purposes, will not be active unless the operator positions his thumb on the release button atop the lever.

It is a specific object of the present invention to provide a control assembly for replacing a plurality of controls of a hydraulically-operated sideboom having a framework means, a boom means pivotally attached to said framework means, boom cable means fixedly attached to said boom means, and load cable means fixedly attached to a pipe load for lifting and lowering said pipe load, and a drawworks assembly configured to be fixedly received by said framework means for operating said boom means with hand-controls, said control assembly comprising: a single joystick control means coupled to said boom cable means and to said load cable means for maneuvering the relative position of either of said boom means or said pipe load separately, or for simultaneously maneuvering the relative position of both said boom means and said pipe load.

It is another specific object of the present invention to provide a control assembly for limiting movement of a load cable means of a hydraulically-operated sideboom having a framework means, a boom means pivotally attached to said framework means, boom cable means fixedly attached to said boom means, said load cable means having a top block means and a load block-hook means combination attached thereon for receiving said load cable means for lifting and lowering a pipe load, a drawworks assembly having boom winch means configured for circumferentially receiving said boom cable and load winch means configured for circumferentially receiving said load cable means, said control assembly comprising: an anti-two-block means electrically connected to said boom winch means and said load winch means for preventing contact between said top block means and said load block-hook means.

It is yet another specific object of the present invention to provide a control assembly for limiting relative movement of a counterweight means and a boom means of a hydraulically-operated sideboom having a framework means pivotally attached to said counterweight means and to said boom means, boom cable means fixedly attached to said boom means, and load cable means fixedly attached to a pipe load for lifting and lowering said pipe load, and a drawworks assembly fixedly attached to said framework means configured for operating said boom means with hand-controls; said control assembly comprising: an anti-tipping means electrically coupled to said counterweight means and to said boom means for preventing tipping of said hydraulically-operated sideboom when the oblique moment of said load-carrying boom means relative to the position of said counterweight means exceeds a predetermined maximum oblique moment to avoid tipping.

These and other objects and features of the present invention will become apparent from the following detailed description, wherein reference is made to the figures in the accompanying drawings in which like numerals refer to like components.

IN THE DRAWINGS

DETAILED DESCRIPTION

Figure 1:
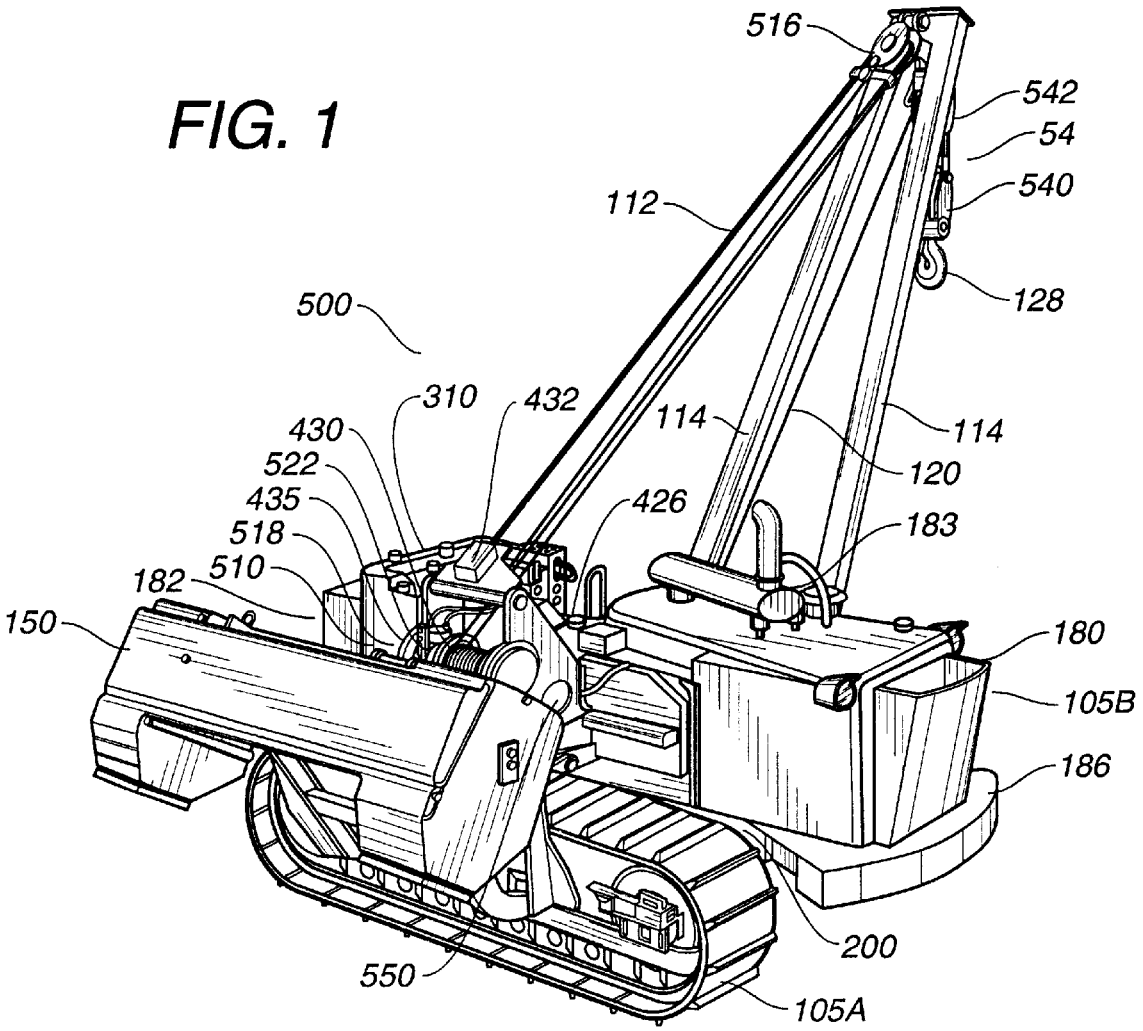
FIG. 1 depicts a frontal perspective view of a hydraulically-operated, low-drive sideboom.

New referring to FIG. 1 there is illustrated a front perspective view of a low-drive hydraulically-operated sideboom 500 comprising drawworks means 510 and control means for controlling the sideboom as will be hereinafter described in detail. Generally shown for such sideboom 500 are pair of endless tracks 105 A and B, boom 114, counterweight assembly 150, diesel engine 180, muffler means 183, and bumper 186. Drawworks 510 includes boom winch 430 and load winch 435. Also shown is operator compartment 310. Boom winch 430 has boom line 112 which is wound around it, and is coupled to upper boom block 516 via boom line 112. In a manner well known in the art, boom line 112 extends from boom winch 430 around upper boom block 516 and then around lower boom block 432 back to upper boom block 516 to which boom line 112 is connected. Load winch 435 has load line 120 which extends around load line sheave 426 and then around load block 542 to hook block 540, which has hook 128 extending therefrom. Hook block 540 and load block 542 constitute a block pair suspended from load line 120. It will be readily understood that rotation of load winch 435 in one direction raises hook block 540, while rotation of load winch 435 in the opposite direction lowers hook block 540.

Thus, drawworks 510 integrates with boom 114, boom cable means 112, load cable means 120, load block assembly 54, counterweight means 150, and, of course, track means 105A and 105B. It will be appreciated by those skilled in the art that drawworks 510 is affixed to framework 200. Also depicted in FIG. 1 is load block assembly 54 comprising upper load block 542 coupled via load line 120 to hook block 540 from which is suspended hook 128 from which, in turn, is suspended a pipe. As will be hereinafter described in detail, under the present invention, load block assembly 54 has the benefit of a novel anti-two-block means.

Figure 3:
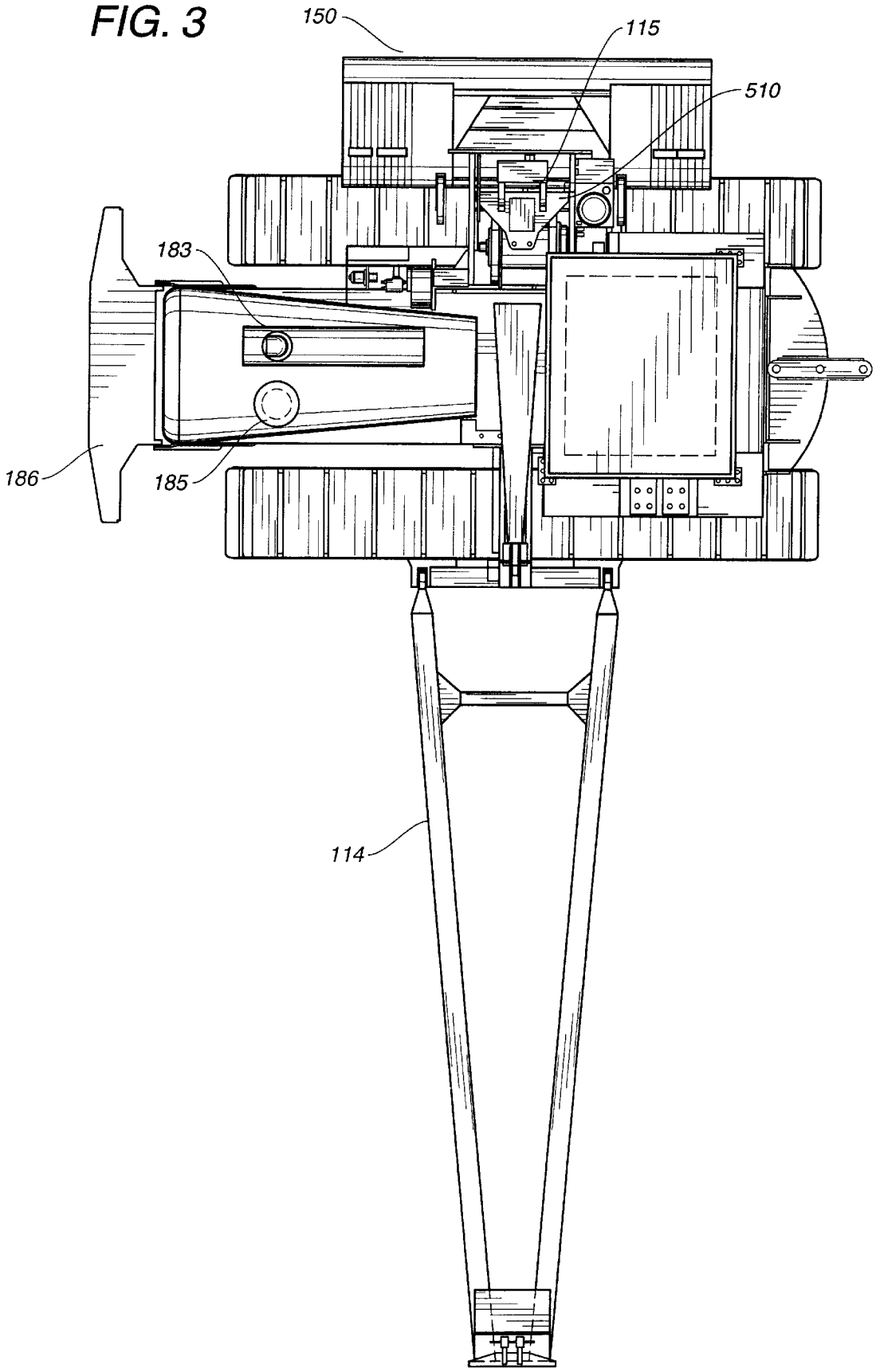
FIG. 3 depicts a top plan view of the preferred embodiment of the sideboom assembly taught by the present invention.

Specifically referring now to FIG. 3, there is shown a top view of apparatus 510 taught by the present invention integrated with a formerly mechanically-operated, low-drive sideboom. Generally depicted therein are lifting boom 114, boom support means 115, bumper 186, muffler 183, engine exhaust 185, and counterweight assembly 150.

Figure 4:
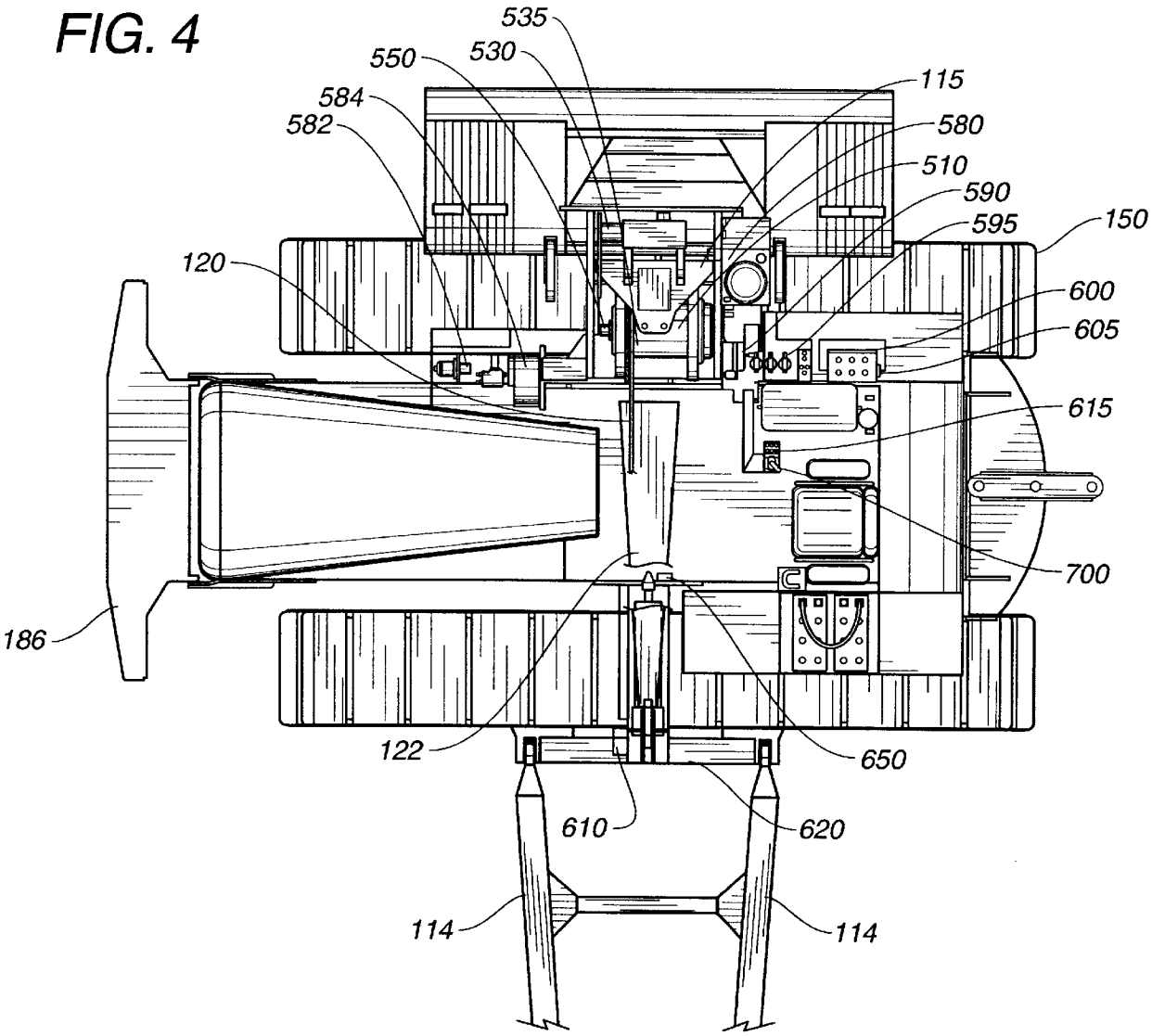
FIG. 4 depicts a detailed top plan view of the assembly depicted in FIG. 3.

FIG. 4 is another a top view of apparatus 510 taught by the present invention integrated with a formerly mechanically-operated low-drive sideboom, showing greater detail than the embodiment depicted in FIG. 3. Drawworks assembly 510 comprises boom winch 530, load winch 535, and conventional hydraulic system components including hydraulic oil tank 580, pump means 582, gear box means 584, distributor valves 590, and electrovalves 595. Load cable 120 is shown contained within cable protection shield 122. The term "electrovalve" is meant to apply to a valve whose positions are actuated electrically, e.g., solenoid-operated valve. Further shown are the plurality of control assembly components which enable sidebooms to be adapted to enjoy the benefits of improved simultaneous manipulation and control of boom and load heretofore unknown in the art.

In particular, shown in FIGS. 3 and 4 are anti-two-block 550 and anti-tipping and anti-two block electric panel 600, horn in electric panel 605 disposed near operator's seat 310, horn 610 disposed on boom sport 620, lift system indicator and control panel 615, and single lever control means 700 affording simultaneous single hand control of boom and load as will be hereinafter described.

Figure 2:
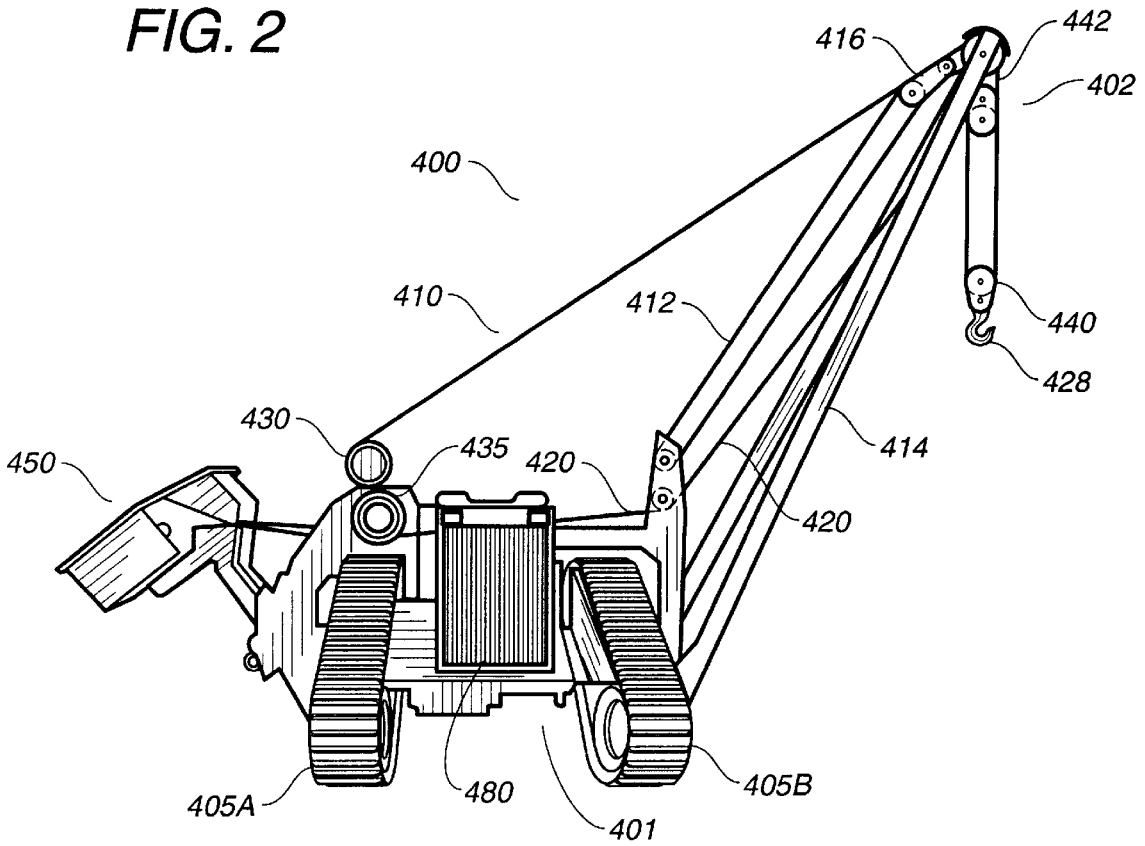
FIG. 2 depicts a frontal perspective view of a hydraulically-operated, high-drive sideboom commonly used in the art.

Now referring to FIG. 2, there is seen a simplified frontal perspective view of a popular modern hydraulically-operated high-drive Caterpillar sideboom commonly used in the art. In particular, hydraulic sideboom 400 comprises pair of endless track means 405 A and B driven by diesel engine means 480, boom means 414 fixedly attached to frame means 401, boom cable means 412, load cable means 420, drawworks 410, and counterweight means 450. Drawworks 410 includes boom cable 412 which hydraulically controls the positioning of boom means 414 as it is either wound around or withdrawn from boom winch 430; similarly, the winding and unwinding movement of load cable 420 relative to load winch 435. Also shown are upper boom block 416 and load block assembly 402, comprising load block 442, hook block 440, and hook means 428. As should be evident to those skilled in the art, hook 428 is suspended from hook block 440 which is coupled to load block 442 via load line 420.

Another aspect of the present invention is an anti-two-blocking feature which prevents contact between upper load block 442 and hook block 440. As is clear to those skilled in the art, two-blocking occurs when power is applied to the load in spite of there being close proximity between the upper load block and the boom block. Not only can block-to-block damage be caused, but also there can be damage to the load and, of course, there can arise a safety hazard wherein the load may be inadvertently released from the hook. Also shown is the electronic switch 650 (see FIG. 4) that prevents the boom 414 from reaching a vertical position.

Figure 5:
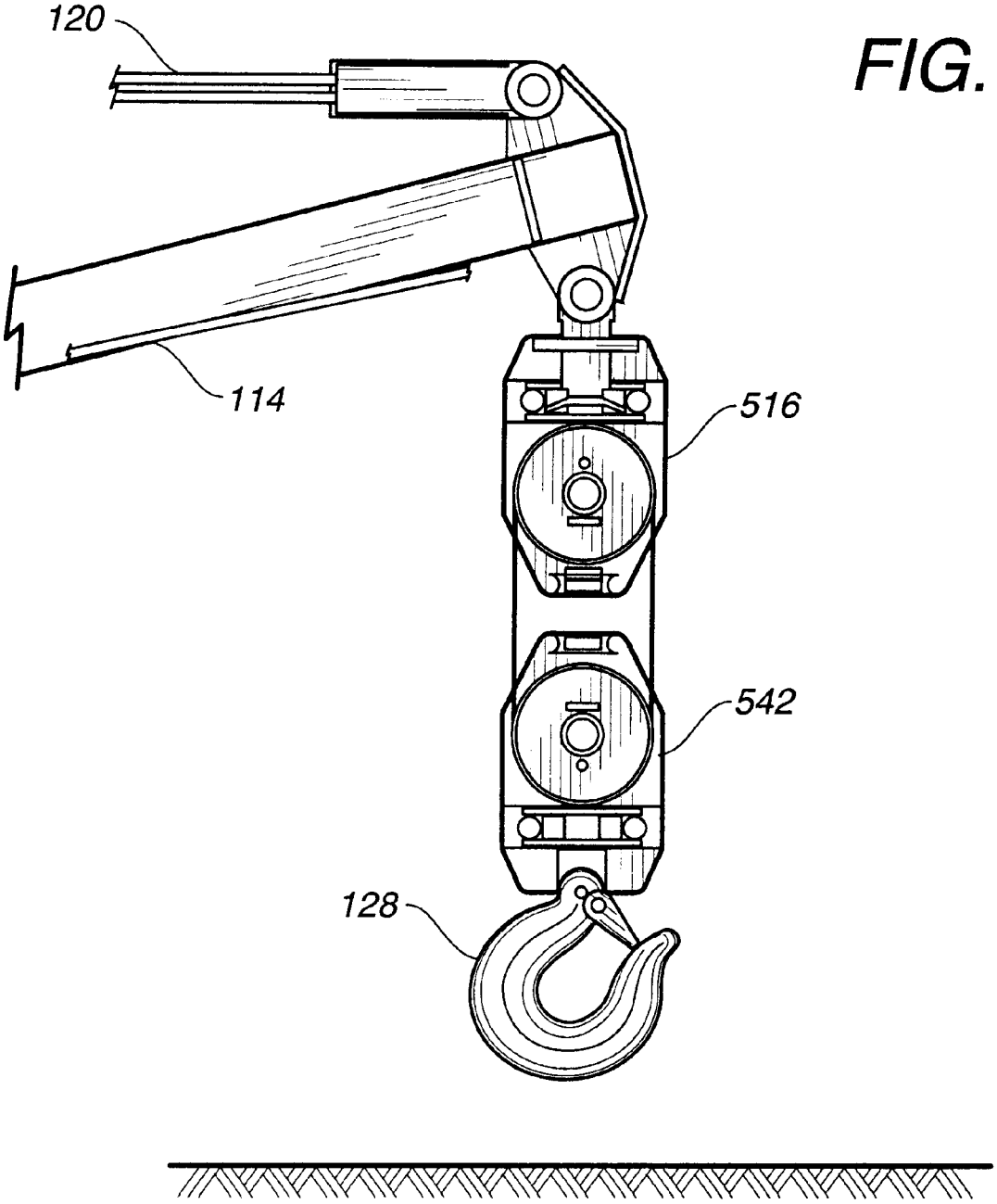
FIG. 5 depicts an enlarged side view of the anti two-block apparatus embodying the present invention.

Referring now to FIG. 5, there is shown an enlarged side view of the load block assembly controlled by the anti-two-block apparatus corresponding to anti two-block control system 550 depicted in FIG. 1. Specifically, there is shown hook block 542 coupled to hook 128 and to upper load block 516. Also shown are boom 114 and boom cable 120. Prior to lifting loads, a sideboom operator purposely positions upper load block 516 and hook block 542 in a proximal relationship. He then presses a button or the like on the control panel which establishes the relative position of the load and the boom winches to each other. This is preferably accomplished under the present invention using timing gear means, coupled to revolution counter means—both comprising anti-two block apparatus 550 (see FIG. 1), which are preset when the designated button in the control panel is pressed. Then, when the timing gears come into the preset relationship, an electrical signal is sent to the electronic control panel and further lifting of the load is immediately prevented.

Figure 6:
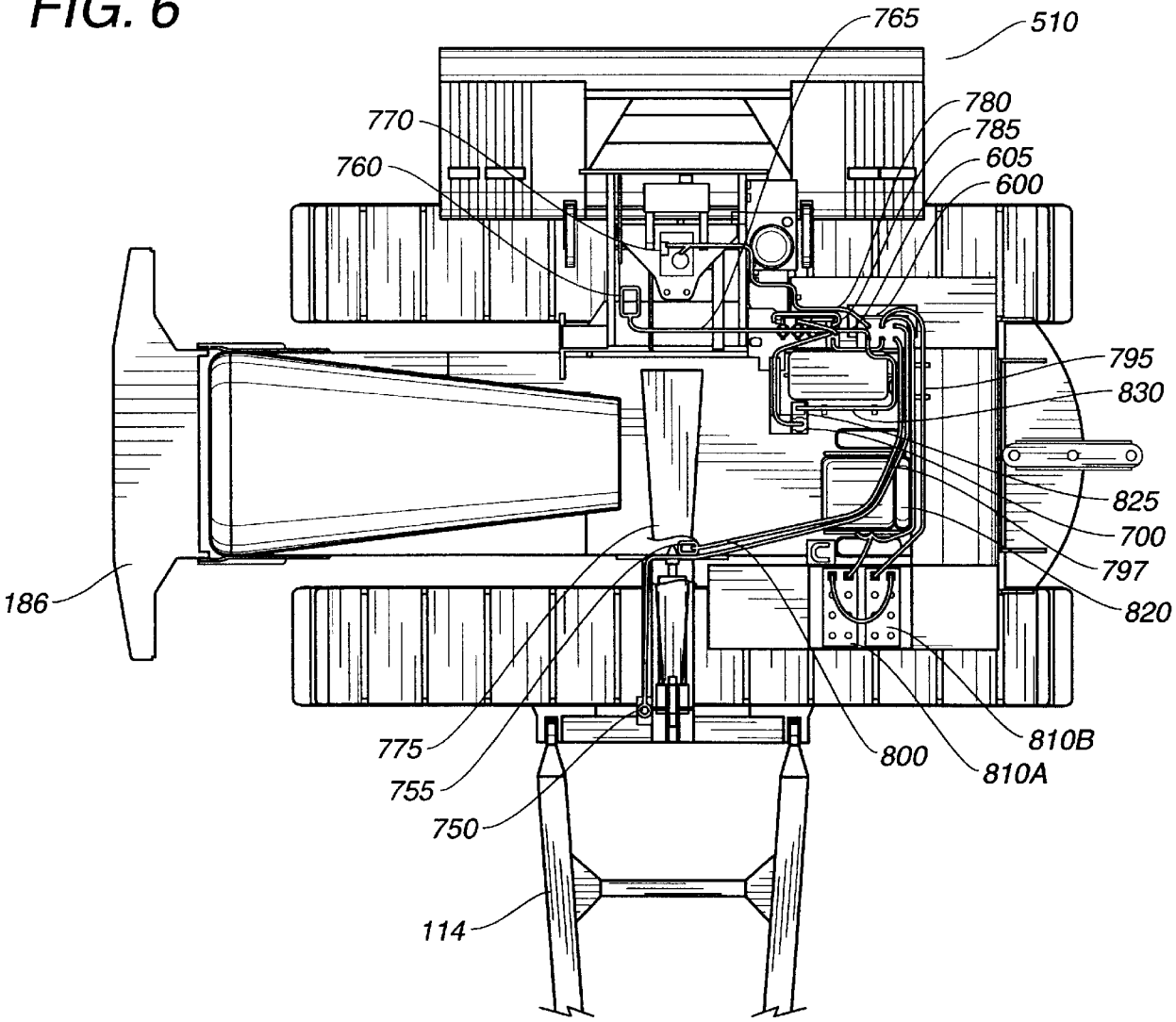
FIG. 6 depicts a simplified top view of the electrical wiring interconnecting the apparatus depicted in FIG. 4.

FIG. 6 shown the positioning of electric cables corresponding to the apparatus depicted in FIG. 4. Now referring to FIGS. 4 and 6, there is seen boom angle sensor and load sensor 770 electrically interconnected with load cell 775 through cable means 780. Anti-two block revolution counter 760 is coupled to a plurality of electrovalves 595 through cable 765. Single joystick control means 700 is electrically coupled to plurality of electrovalves 595 and to junction electric box 785 through cable 805 as will be hereinafter described. As clearly seen in FIG. 6, each of the following are interconnected with electronic control panel 600; vertical boom kick-out cable means 800, angle sensor cable means 780 (coupled to angle sensor 770), horn alarm cable means 820 (coupling horn means 605 in electric panel and side horn means 610), single joystick control cable means 805 (coupling single joystick control means 700 and electrovalves 595), and battery cables 795 (interconnecting battery 810A) and 797 (interconnecting battery 810B).

Figure 7:
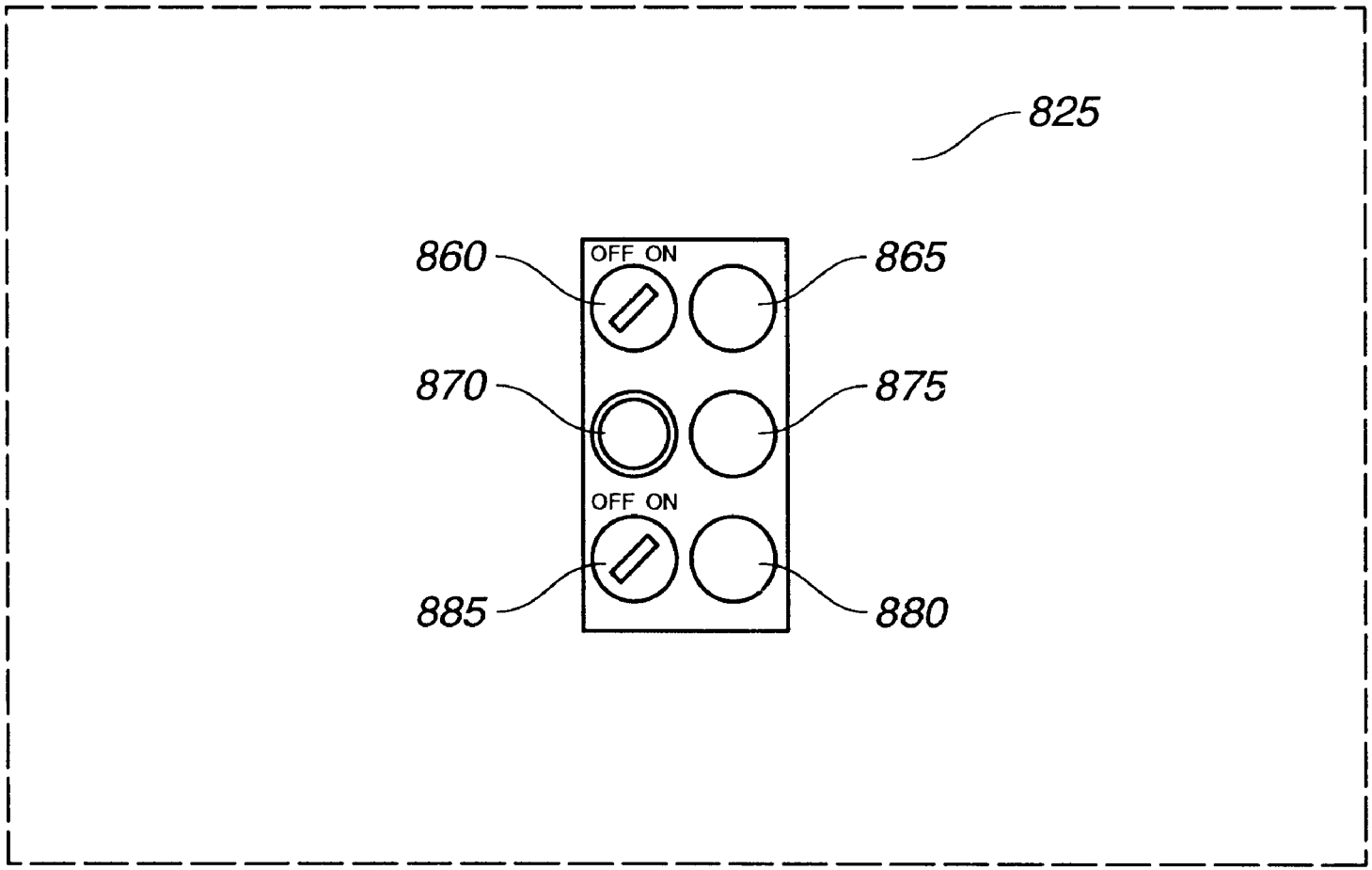
FIG. 7 depicts an enlarged view of the operator's electronic indicator and control panel, related to the anti-tipping feature of the present invention.

FIG. 7 depicts an enlarged view of electronic indicator and control panel 825 disposed proximal to joystick control means 700 and depicted in FIG. 6. Shown therein are plurality of indicators which communicate the condition of sideboom operation. Starting at the upper left, the master switch 860 is positioned either in an on or off position by key-activation. A power "on" condition is illustrated when indicator 865 is illuminated by a green light. If electric fault indicator 870 is illuminated by a white light, that indicates than an electrical fault has occurred. Indicators 875 and 880 are used to signal an anti-tipping situation. First, indicator 875 is illuminated by a yellow light when an overload situation is imminent. Next, indicator 880 is illuminated by a red light at the instant that an overload occurs. It should be evident to those skilled in the art that this control panel is situated adjacent the operator's seat so that the operator may readily see the status of the indicators, and so that the pipelayer system may be immediately shut off if necessary. An anti-tipping system by-pass switch means 885 is either in an on or off position; this switch is typically controlled using a key means, a spring-loaded switch, or the like.

Sidebooms contemplated by the present invention should preferably include a computerized anti-tipping feature that measures the angle of the boom and the load thereon. According to the present invention, a microprocessor means or the like calculates the sideboom's oblique tipping moment and compares this moment against a predetermined maximum value. It is an advantage of the present invention that unstable sideboom operation due to tipping is precluded because this maximum stable tipping moment is not exceeded.

Referring to FIGS. 6 and 7, as will be evident to those skilled in the art, when this tipping moment limit is being approached, the microprocessor informs the operator by illuminating indicator 875, preferably with a yellow warning light. If, and when the moment stability threshold is actually reached, the microprocessor further informs the operator by illuminating indicator 880, preferably with a red warning light and all the lifting action ceases. Simultaneously, to signal an incipient dangerous condition, the present invention also sounds an alarm via a plurality of horn means electrically interconnected with electronic control panel 600. As will be evident to practitioners in the art, upon this alarm condition occurring, an operator has no choice but to return the sideboom to a stable condition by reducing the oblique tipping moment: the load must be lowered and/or the load must be moved closer to the sideboom, or both. It will be appreciated that this anti-tipping feature provides safe and convenient operation of sidebooms. This combination has heretofore been unknown in the sideboom art.

Figure 8A:
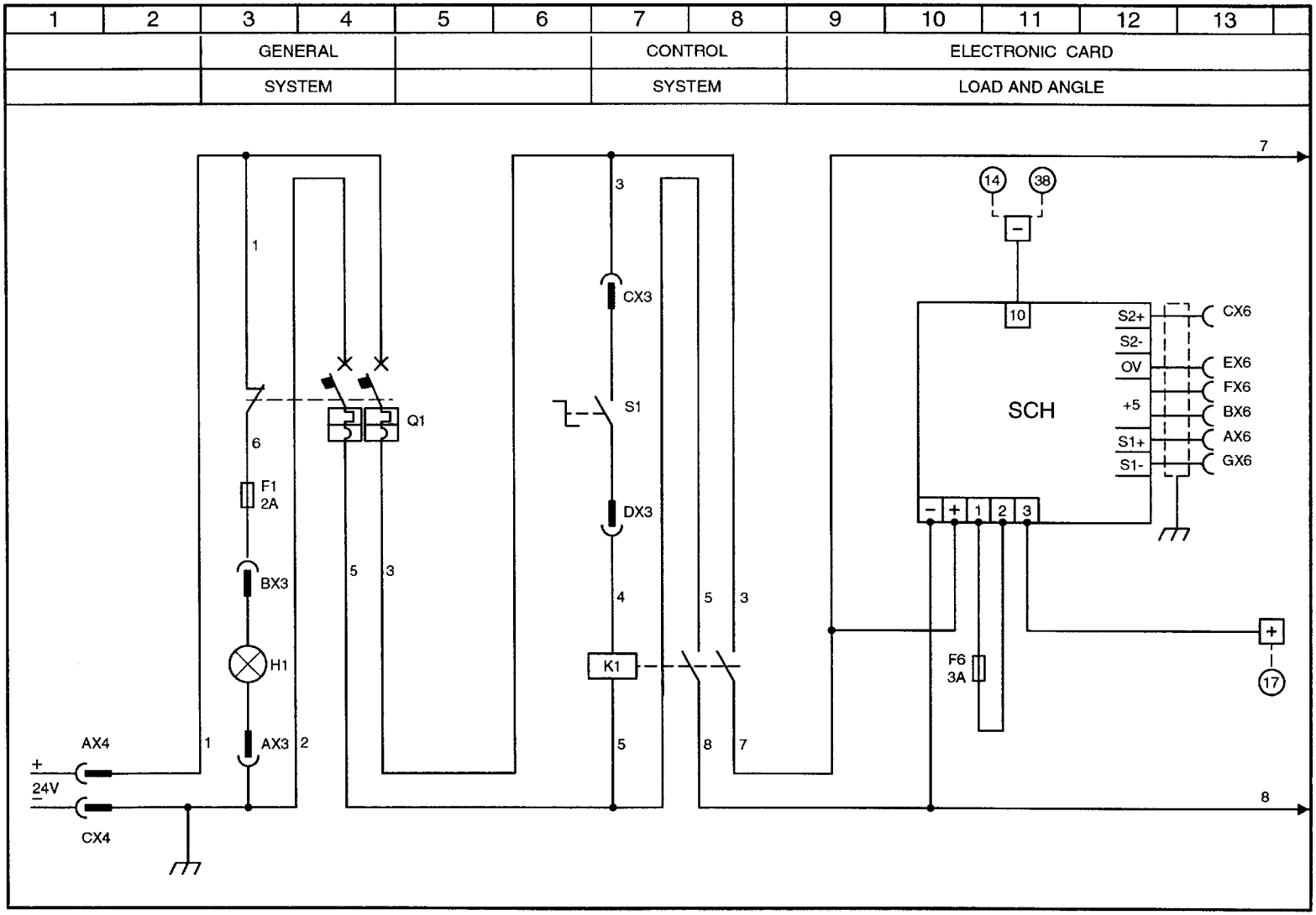
FIGS. 8A–8C depict a schematic of the internal circuitry of the anti-tipping apparatus embodying the present invention.
Figure 8B:
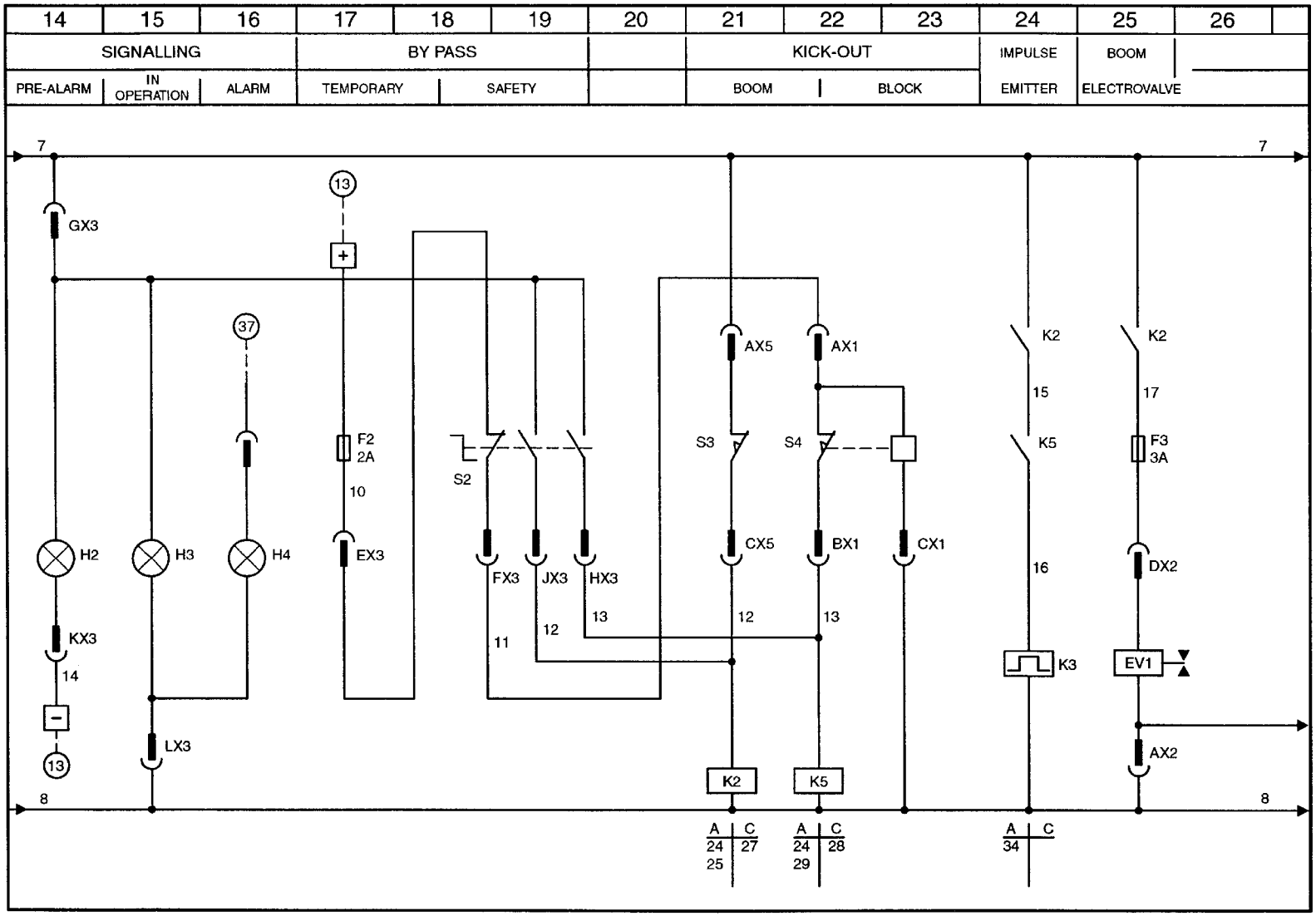
Figure 8C:
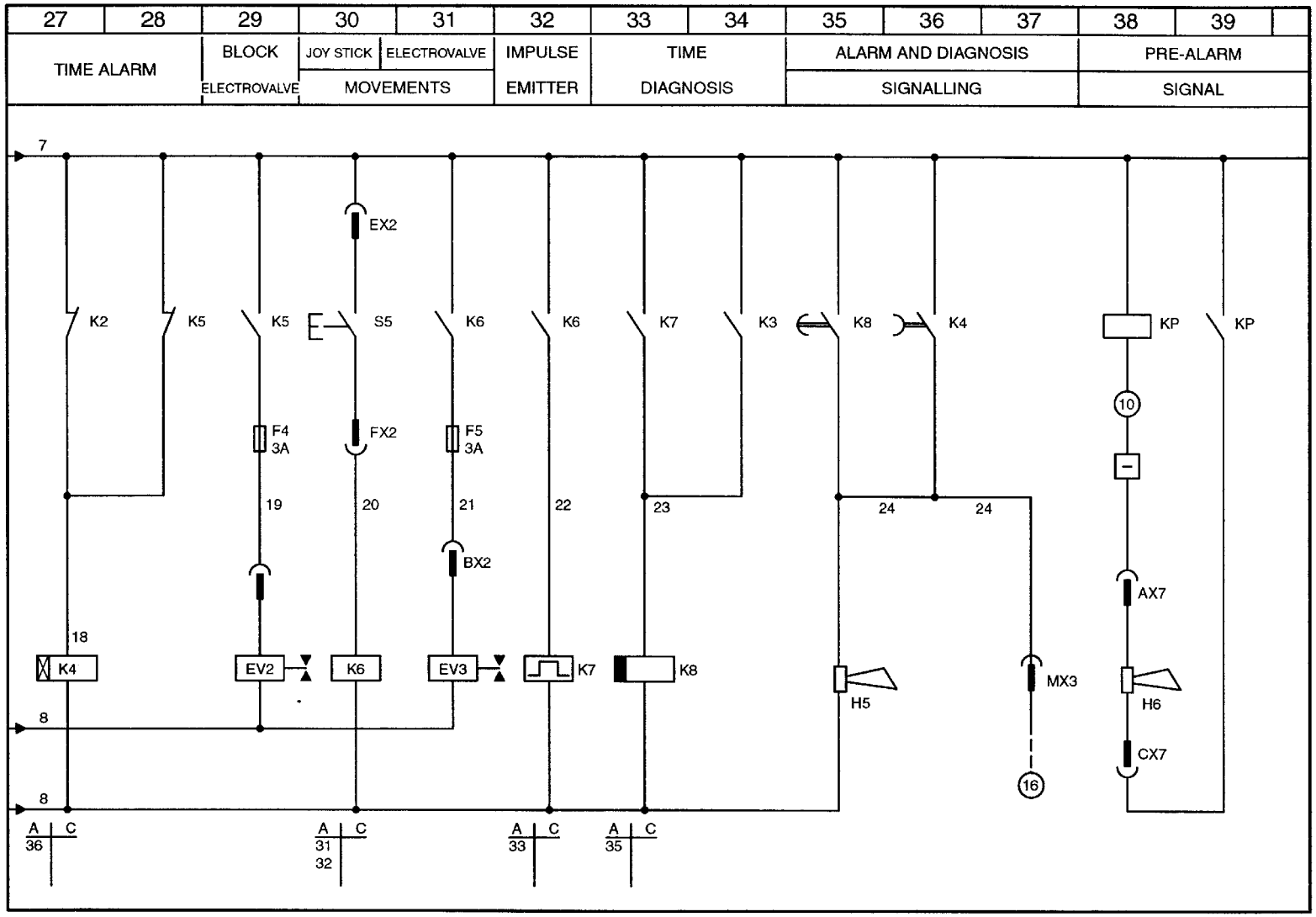

FIGS. 8A–C depict a schematic of the anti-tipping feature contemplated by the present invention. Represented at the top of each of FIGS. 8A–C are captions which indicate the portion of the electronic circuitry being described in the schematic. Referring to FIG. 8A, shown are the components comprising the general system, the control system, and the electronic card load and angle. General system components shown include pair of 23 amp four poles panel sockets AX4 and CX4; 5×50 2 amp fuse F1; pair of 19 poles panel socket AX3 and BX3; white light magnetotermic device (in control panel) H1; and 10 amp magnetotermic device Q1. Components shown comprising the control system are pair of 19 poles panel socket CX3 and DX3; system control selector (in control panel) S1; and system control contactor K1. For the right portion of FIG. 9A, corresponding to electronic card load and angle, the components shown are load and angle electronic card SCH and related control panel components safety temporary key by-pass selector S2 and system control selector S1; and plurality of 7 poles panel sockets AX6, BX6, CX6, EX6, FX6, and GX6; and 3 amp fuse F6.

Referring now to FIG. 8B, shown are the components comprising the signaling feature of the present invention including pre-alarm, normal operation, and alarm; by-pass feature including temporary and safety; kick-out feature including boom and load (labeled as block); impulse emitter; and boom electrovalve. Signaling pre-alarm system components shown include 19 poles panel socket GX3; pre-alarm orange or yellow indicator light H2; and 19 poles panel socket KX3. Signaling normal operation components shown are power green light indicator (control panel) H3 and 19 poles panel socket LX3. Signaling alarm components include alarm red light indicator (control panel) H4 and 19 poles panel socket X3. By-pass temporary feature components include 2 amp 5×20 fuse F2 and 19 poles panel socket EX3. By-pass safety feature components include safety temporary key by-pass selector (control panel) S2 and 19 poles panel sockets FX3, JX3, and HX3. Kick-out boom and load feature components include 13 amp 4 poles panel socket AX5; 10 poles panel socket AX1; kick-out boom S3; hook block winch encoder S4; 13 amp 4 poles panel socket CX5; 10 poles panel sockets BX1 and CX1; boom contactor K2; and block contactor K5. Impulse emitter feature components shown include boom contactor K2; block contactor K5; and impulse emitter K3. Boom electrovalve feature components shown include boom contactor K2; 3 amp 5×20 fuse F3; 14 pole panel sockets DX2 and AX2; and boom electrovalve EV1.

Referring now to FIG. 8C, shown are the components comprising the time alarm feature of the present invention; block electrovalve; joystick and electrovalve movements: impulse emitter; time diagnosis; alarm and diagnosis signaling; and pre-alarm signal. Time alarm system components shown include boom contactor K2; excitation delayed alarm timer K4; and block contactor K5. Block electrovalve components shown include block contactor K3; 3 amp 5×20 fuse F4; 14 poles panel socket CX2; and block electrovalve EV2. Single control lever/joystick feature components shown include hydraulic joystick switch S5; 14 panel sockets EX2 and FX2; and joystick movement contactor K6. Electrovalve movements feature components shown include joystick movement contactor K6; 3 amp 5×20 fuse F5; 14 poles panel socket BX2; and joystick movement electrovalve EV3. Impulse emitter components shown include joystick movement contactor K6; and impulse emitter K7. Time diagnosis feature components shown include impulse emitters K7 and K3; and disexcitation delayed diagnosis timer K8. Alarm and diagnosis signaling components shown include disexcitation delayed diagnosis timer K8; excitation delayed alarm timer K4; alarm and diagnosis horn H5; and 19 poles panel socket MX3. Pre-alarm signal components shown include KP; AX7 and CX7; and alarm and diagnosis horn H6.

Figure 9:
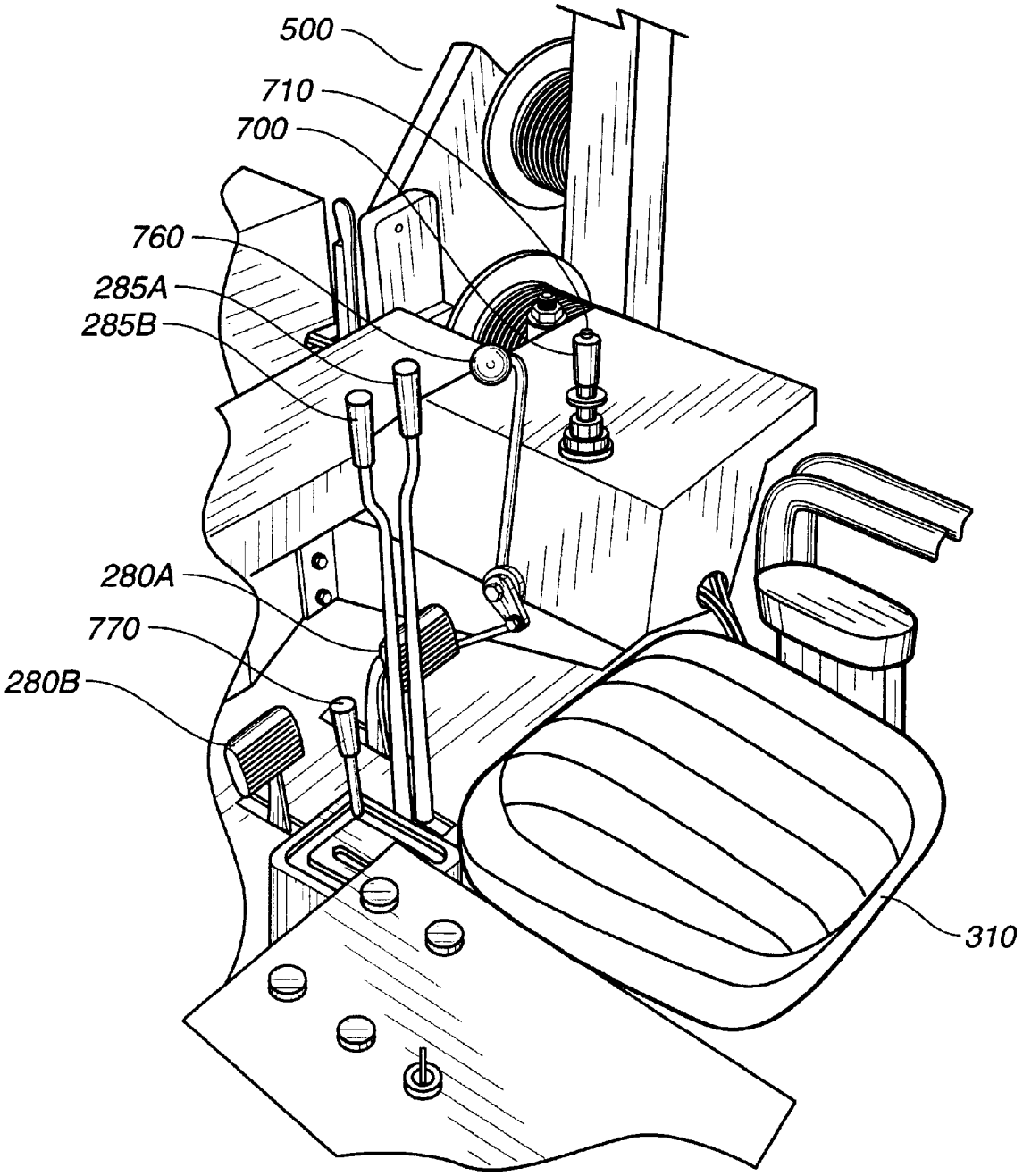
FIG. 9 depicts a perspective top view of the controls available to the operator under the present invention, including the single lever control apparatus.

Specifically referring now to FIG. 9, there is shown the simplified control means 500 taught by the present invention. As will become clear to those skilled in the art, joystick means 700 replaces the conventional 6 controls that are necessary to control all of the movements of boom line 112 and load line 120. Also shown are the steering clutches 285A and 285B, foot-actuated band brakes 280A and 280B, and throttle 760, all of which are unchanged after the conversion.

Figure 10:
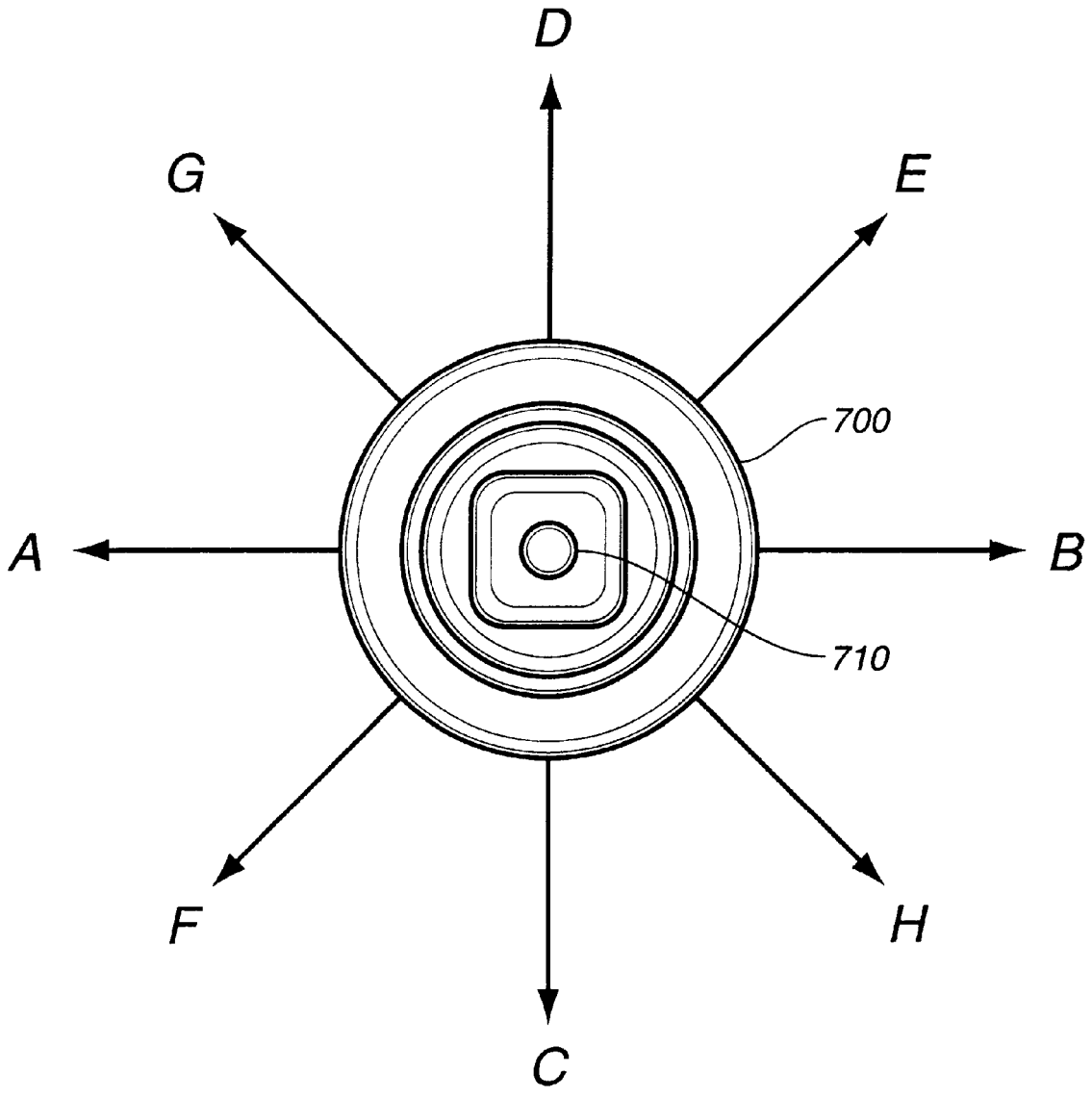
FIG. 10 depicts a simplified top planar view depicting the eight control positions of the single lever control apparatus depicted in FIG. 9.

Now referring to FIGS. 1 and 10, there is shown the joystick control means 700 that controls all of the lifting functions of the sideboom. As depicted in position A, joystick 700 is pivoted into a left horizontal direction to move the boom 114 affixed to boom line 112 downwards. Contrariwise, as depicted in position B, joystick 700 is pivoted into a right horizontal direction to move the boom 114 affixed to boom line 112 upwards. Similarly, as depicted in position C, joystick 700 is pivoted inwardly toward the operator to move hook means 128 affixed to load line 120 upwards. Contrariwise, as depicted in position D, joystick 700 is pivoted outwardly from the operator to move hook means 128 affixed to load line 120 downwards. Similarly, as depicted in position E, joystick 700 is pivoted into a diagonal direction to the right and outwardly away from the operator to both move boom 114 upwards and hook 128 downwards (approximately a 2 o'clock position). Contrariwise, as depicted in position F, joystick 700 is pivoted into a diagonal direction to the left and inwardly towards the operator to both move boom 114 downwards and hook 128 upwards (approximately an 8 o'clock position). As depicted in position G, joystick 700 is pivoted into a diagonal direction to the left and outwardly away from the operator to both move boom 114 downwards and hook 128 downwards (approximately a 10 o'clock position). Contrariwise, as depicted in position H, joystick 700 is pivoted into a diagonal direction to the right and inwardly towards the operator to both move boom 114 upwards and hook 128 upwards (approximately a 4 o'clock position).

Thus, as will be clear to those skilled in the art, if an operator must make a sudden change in the disposition of a sideboom, the joystick feature of the present invention enables such change to be effectuated immediately: the operator merely manipulates the joystick means taught by the present invention in the proper direction and the change in boom and/or hoist disposition is immediate. Heretofore, as is readily understood by those skilled in the art, effecting changes using the conventional hydraulic ensemble of controls requires more manual coordination to manipulate the multiple hydraulic controls. It is an advantage and feature of the present invention that an ability to instantaneously and easily effect all sideboom movements is achieved by a single joystick control means heretofore unknown in the art.

It should be further understood, however, that since the operation of the boom and load lines have been rendered profoundly easy and convenient by the present invention, requiring only one hand for all movements thereof, it has been found to be advantageous for safety reasons to include a locking means which must be activated before joystick means 700 is, in turn, activated. Thus, in the preferred embodiment of the present invention, thumb release activator button 710 protrudes atop joystick 700 and must be both depressed and held down in this depressed position in order for the joystick operation described herein to be effectuated. That is, if thumb release actuator button means 710 is not held in a depressed position, an electronic micro switch renders joystick means 700 unable to effect any movement of either boom drum 430 or load drum 435.

It will be observed by those skilled in the art that, according to the present invention, braking is automatically actuated when joystick means 700 is in its default vertical position. The operator merely releases the joystick and all braking means are automatically actuated. Thus, sideboom controls taught by the preferred embodiment of the present invention afford the benefit of convenient, smooth and simultaneous manipulation of the load and boom which heretofore as generally been known only in applications such as video games and the like. Of course, as will be evident to those skilled in the art, foot and hand controls required to propel the entire machine via its crawler undercarriage forward and backward have not been affected by the present invention.

Other variations and modifications will, of course, become apparent from a consideration of the structures and techniques herein before described and depicted. Similarly, references to Caterpillar, Komatsu, Fiat-Allis, and Mid-Western sidebooms herein are included for illustration purposes only and are not intended to limit the scope or extent of the present invention. Accordingly, it should be clearly understood that the present invention is not intended to be limited by the particular features and structures herein before described and depicted in the accompanying drawings, but that the present invention is to be measured by the scope of the appended claims herein.

What is claimed is:

1. A control assembly for replacing a plurality of controls of a hydraulically-driven sideboom for lifting and lowering a heavy load, having a rigid framework, a drive shaft, a boom pivotally attached to said rigid framework, boom cable means fixedly attached to said boom load cable means fixedly attached to a load for lifting and lowering said load, and a drawworks assembly coupled to said boom cable means and to said load cable means, and configured to be fixedly received by said framework for operating said boom cable means and said load cable means with hand-controls, said control assembly comprising:

a single lever joystick control means coupled to said drawworks assembly having a hydraulic pump coupled to said drive shaft for controlling the movement of said boom cable means and of said load cable means for, in turn maneuvering the relative position of either of said boom or said load separately, and for simultaneously maneuvering the relative position of both said boom and said load.

2. The apparatus of claim 1, wherein said single lever joystick control means includes actuator switch means disposed adjacent said single lever joystick control means for enabling said maneuvering of said boom and said load when said actuator switch means is depressed.

3. The apparatus of claim 2, wherein said actuator switch means is disposed atop said single lever joystick control means for thumb actuation.

4. The apparatus of claim 3, wherein said single lever joystick control means comprises a plurality of positions for controlling said movement of said boom cable means and of said load cable means for causing said maneuvering of said boom and said load.

5. The apparatus recited in claim 4, wherein said plurality of positions of said single lever joystick control means includes a first position for maneuvering said boom in a downward direction.

6. The apparatus recited in claim 4, wherein said plurality of positions of said single lever joystick control means includes a second position for maneuvering said boom in an upward direction.

7. The apparatus recited in claim 4, wherein said plurality of positions of said single lever joystick control means includes a third position for maneuvering said boom in a downward direction.

8. The apparatus recited in claim 4, wherein said plurality of positions of said single lever joystick control means includes a fourth position for maneuvering said boom in an upward direction.

9. The apparatus recited in claim 4, wherein said plurality of positions of said single lever joystick control means includes a fifth position for simultaneously maneuvering said boom in an upward direction and said load in a downward direction direction.

10. The apparatus recited in claim 4, wherein said plurality of positions of said single lever joystick control means includes a sixth position for simultaneously maneuvering said boom in a downward direction and said load in an upward direction direction.

11. The apparatus recited in claim 4, wherein said plurality of positions of said single lever joystick control means includes a seventh position for simultaneously maneuvering said boom in a downward direction and said load in a downward direction direction.

12. The apparatus recited in claim 4, wherein said plurality of positions of said single lever joystick control means includes a eighth position for simultaneously maneuvering said boom in an upward direction and said load in an upward direction direction.

* * * * *